US009488946B2

(12) United States Patent
Sakurai et al.

(10) Patent No.: US 9,488,946 B2
(45) Date of Patent: Nov. 8, 2016

(54) IMAGE FORMING APPARATUS, IMAGE FORMING SYSTEM AND CONCENTRATION UNEVENNESS DETECTING METHOD

(71) Applicant: Konica Minolta, Inc., Tokyo (JP)

(72) Inventors: Shota Sakurai, Tokyo (JP); Tatsuya Furuta, Tokyo (JP); Kazuhiro Saito, Tokyo (JP); Kazuteru Ishizuka, Saitama (JP); Tomohiro Kawasaki, Kanagawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/880,872

(22) Filed: Oct. 12, 2015

(65) Prior Publication Data

US 2016/0124343 A1 May 5, 2016

(30) Foreign Application Priority Data

Nov. 4, 2014 (JP) ..... 2014-224124

(51) Int. Cl.

*G03G 15/08* (2006.01)
*G03G 15/10* (2006.01)
*G03G 15/00* (2006.01)

(52) U.S. Cl.

CPC ..... *G03G 15/5058* (2013.01); *G03G 15/0824* (2013.01); *G03G 15/105* (2013.01); *G03G 2215/0135* (2013.01); *G03G 2215/0164* (2013.01)

(58) Field of Classification Search

CPC ..... G03G 15/0824; G03G 15/0827; G03G 15/0849; G03G 15/105; G03G 2215/0888; G03G 2215/00569

See application file for complete search history.

(56) References Cited

U.S. PATENT DOCUMENTS 5,649,267 A * 7/1997 Aerens ..... B23P 11/025 399/159
2006/0239701 A1* 10/2006 Ishibashi ..... G03G 15/0853 399/30
2014/0161472 A1* 6/2014 Saito ..... G03G 15/0856 399/27

FOREIGN PATENT DOCUMENTS

JP 2006-084796 3/2006
JP 2013-195586 9/2013
JP 2014-116711 6/2014

* cited by examiner

*Primary Examiner* — Rodney Bonnette
(74) *Attorney, Agent, or Firm* — Squire Patton Boggs (US) LLP

(57) ABSTRACT

An image forming apparatus includes: a rotatable image carrier; an image forming unit configured to form a plurality of divided patch images, which is obtained by dividing a patch image for detecting a concentration of an image in a rotation direction of the image carrier, on the image carrier at regular intervals and form an image to be formed on a paper sheet on the image carrier; a concentration detecting unit configured to detect the concentration of the plurality of divided patch images formed by the image forming unit; and a controller configured to combine the concentration of divided patch images detected by the concentration detecting unit in chronological order and detect concentration unevenness of the image in the vertical scanning direction which is a paper sheet conveying direction of the paper sheet.

12 Claims, 6 Drawing Sheets

FIG. 5

VERTICAL SCANNING DIRECTION

| GENERATION POSITION OF DENSITY UNEVENNESS | PATCH IMAGE | | | |
|---|---|---|---|---|
| | PATCH IMAGE CYCLE | PERIOD | FORM DIVIDED PATCH IMAGE | CORRESPONDING POSITION ON PHOTORECEPTOR DRUM |
| A | FIRST CYCLE | R1 | | |
| B | | R2 | ○ | B |
| C | | R3 | | |
| D | | R4 | | |
| E | | R5 | | |
| A | | R6 | | |
| B | | R7 | | |
| C | | R8 | | |
| D | SECOND CYCLE | R1 | ○ | D |
| E | | R2 | | |
| A | | R3 | | |
| B | | R4 | | |
| C | | R5 | | |
| D | | R6 | | |
| E | | R7 | | |
| A | | R8 | ○ | A |
| B | THIRD CYCLE | R1 | | |
| C | | R2 | | |
| D | | R3 | | |
| E | | R4 | | |
| A | | R5 | | |
| B | | R6 | | |
| C | | R7 | ○ | C |
| D | | R8 | | |
| E | FOURTH CYCLE | R1 | | |
| A | | R2 | | |
| B | | R3 | | |
| C | | R4 | | |
| D | | R5 | | |
| E | | R6 | ○ | E |
| A | | R7 | | |
| B | | R8 | | |
| C | FIFTH CYCLE | R1 | | |
| D | | R2 | | |
| E | | R3 | | |
| A | | R4 | | |
| B | | R5 | ○ | B |
| ⋮ | ⋮ | ⋮ | ⋮ | ⋮ |

IMAGE FORMING APPARATUS, IMAGE FORMING SYSTEM AND CONCENTRATION UNEVENNESS DETECTING METHOD

The entire disclosure of Japanese Patent Application No. 2014-224124 filed on Nov. 4, 2014 including description, claims, drawings, and abstract are incorporated herein by reference in its entirety.

BACKGROUND OF THE INVENTION

Field of the Invention

The present invention relates to an electrographic image forming apparatus, an image forming system, and a concentration unevenness detecting method.

Description of the Related Art

In general, an image forming apparatus (such as a printer, a copying machine, and a facsimile) for using electrophotographic processing technology forms an electrostatic latent image by irradiating (expose) a charged photoreceptor with a laser beam based on image data. The electrostatic latent image is visualized and a toner image is formed by supplying a toner to a photoreceptor drum, on which the electrostatic latent image is formed, from a developing device. In addition, after the toner image has been directly or indirectly transferred to a paper sheet, the toner image is fixed by heating or pressurizing with a fixing nip, and accordingly, the image is formed on the paper sheet.

Further, an image forming system has put into practical use in which the former stage of the image forming apparatus is connected to a paper feeder and the latter stage is connected to a paper ejector. The paper feeder feeds a continuous paper sheet (referred to as "long paper sheet" below) such as continuous rolled paper and folded paper, and the paper ejector stores the long paper sheet on which the image has been formed by the image forming apparatus.

There is a problem in that, in this image forming apparatus, the image quality of the output image (image formed on the paper sheet) is deteriorated by deterioration of the photoreceptor drum, developer, and the like with time, the ambient environment of the device (change of temperature and humidity), and the like. Specifically, a phenomenon occurs in which colors of the input image are not faithfully reproduced in the output image and a color tone of the image is different from that of the other image. The image forming apparatus in the related art performs image stabilization control so that color reproducibility and color stability are secured.

In the image stabilization control, for example, an optical sensor detects the concentration of a patch image (toner pattern) formed on the photoreceptor drum, and the feedback of the detection result is reflected to an image forming condition such as a charged potential, a developing potential, and an exposure amount. Accordingly, the concentration of the image is corrected. Generally, the image stabilization control is regularly performed by using a non-image forming region when the image is continuously formed on the plurality of paper sheets.

Further, in the image forming apparatus, there is a case where concentration unevenness in the circumferential direction (vertical scanning direction) is generated in the toner image formed on the photoreceptor drum. The concentration unevenness is caused by change of the distance between the photoreceptor drum and a developing roller due to rotational deflection of the developing roller and humidity unevenness in the rotary axis direction of the photoreceptor drum. In this case, in the image formed on the paper sheet, the concentration unevenness is generated by synchronizing with the rotation cycles of the developing roller and the photoreceptor drum. The humidity unevenness in the axis direction of the photoreceptor drum is generated as follows. When the image forming apparatus is left stopping for a long time under high temperature and high humidity environment, air circulation in the image forming apparatus is lowered, and the humidity in a certain part on the photoreceptor drum becomes higher. Accordingly, the charge cannot be normally performed, and the humidity unevenness is generated. JP 2014-116711 A and JP 2013-195586 A disclose an image forming apparatus which can form an image with high quality by preventing this periodic concentration unevenness.

In the technique disclosed in JP 2014-116711 A, a predetermined print device, of which the concentration unevenness in the vertical scanning direction is a target to be corrected, continuously prints a plurality of test charts to measure the concentration unevenness in the vertical scanning direction. Profiles of the measured data obtained by optically reading them are connected in a print order in consideration of a paper gap. The connected data is divided into a plurality of pieces of data for each specific cycle, and effective data at all positions on the specific cycle in the plurality of pieces of data is averaged, and the averaged data is analyzed. According to the analysis, the concentration unevenness in the vertical scanning direction is detected, and correction data to remove the concentration unevenness in the vertical scanning direction generated in each specific cycle is created.

In the technique disclosed in JP 2013-195586 A, an image forming apparatus has a pattern forming unit which forms concentration change detecting patterns having a plurality of generation cycles on an endless belt along the conveying direction of the endless belt, a concentration sensor which detects the concentration change detecting pattern and outputs a concentration signal including information on a change of the concentration in the conveying direction of the endless belt, and a cycle detecting sensor which detects a plurality of cycles included in the change of the concentration.

However, regarding the technique disclosed in JP 2014-116711 A, it is necessary to separately print a test chart during normal image forming processing, and accordingly, the decrease of productivity has been a problem. On the other hand, the technique disclosed in JP 2013-195586 A is different from that in JP 2014-116711 A. It is not necessary to print the test chart during the normal image forming processing. However, since the concentration unevenness is generated at various cycles such as a cycle of the developing roller and a cycle of the photoreceptor drum, it is necessary to use a paper gap having a certain size (a region between an image forming region where the toner image to be transferred to a single paper sheet is formed and another image forming region, and a region where the concentration change detecting pattern is formed) to detect the concentration unevenness. The concentration unevenness cannot be sufficiently detected according to the size of the paper gap. Further, when the concentration unevenness is detected in the image forming system for forming the label image on the long paper sheet (label roll), it can be considered to form the concentration change detecting pattern in a margin instead of the paper gap. However, since the label images are formed on the long paper sheet at regular intervals, it is necessary to form the concentration change detecting patterns at regular intervals. There are many cases where the size of the concentration change detecting pattern which can be formed in the margin is not large enough to detect the concentration unevenness at one time.

SUMMARY OF THE INVENTION

An object of the present invention is to provide an image forming apparatus, an image forming system, and a concentration unevenness detecting method which can surely detect concentration unevenness in the vertical scanning direction.

To achieve the abovementioned object, according to an aspect, an image forming apparatus reflecting one aspect of the present invention comprises: a rotatable image carrier; an image forming unit configured to form a plurality of divided patch images, which is obtained by dividing a patch image for detecting a concentration of an image in a rotation direction of the image carrier, on the image carrier at regular intervals and form an image to be formed on a paper sheet on the image carrier; a concentration detecting unit configured to detect the concentration of the plurality of divided patch images formed by the image forming unit; and a controller configured to combine the concentration of divided patch images detected by the concentration detecting unit in chronological order and detect concentration unevenness of the image in the vertical scanning direction which is a paper sheet conveying direction of the paper sheet.

To achieve the abovementioned object, according to an aspect, an image forming system reflecting one aspect of the present invention comprises: a paper feeder configured to feed a long paper sheet; an image forming apparatus configured to form an image on the long paper sheet fed by the paper feeder; and a paper ejector configured to store the long paper sheet on which the image has been formed by the image forming apparatus, wherein the image forming apparatus includes a rotatable image carrier, an image forming unit which forms a plurality of divided patch images, which is obtained by dividing a patch image for detecting a concentration of an image in a rotation direction of the image carrier, on the image carrier at regular intervals and forms an image to be formed on a paper sheet on the image carrier, a concentration detecting unit which detects the concentration of the plurality of divided patch images formed by the image forming unit, and a controller which combines the concentrations of divided patch images detected by the concentration detecting unit in chronological order and detects concentration unevenness of the image in the vertical scanning direction which is a paper sheet conveying direction of the paper sheet.

To achieve the abovementioned object, according to an aspect, a concentration unevenness detecting method reflecting one aspect of the present invention comprises: forming a plurality of divided patch images which is obtained by dividing a patch image for detecting a concentration of an image in a rotation direction of an image carrier on the image carrier at regular intervals and forming the image to be formed on a paper sheet on the image carrier; detecting the concentration of the formed plurality of divided patch images; and combining the concentration of the detected divided patch images in chronological order and detecting concentration unevenness of the image in the vertical scanning direction which is a paper sheet conveying direction of the paper sheet.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 5 is a table of a relation between the generation positions of the concentration unevenness and forming cycles of the divided patch images.

DESCRIPTION OF THE PREFERRED EMBODIMENTS

Figure 1:
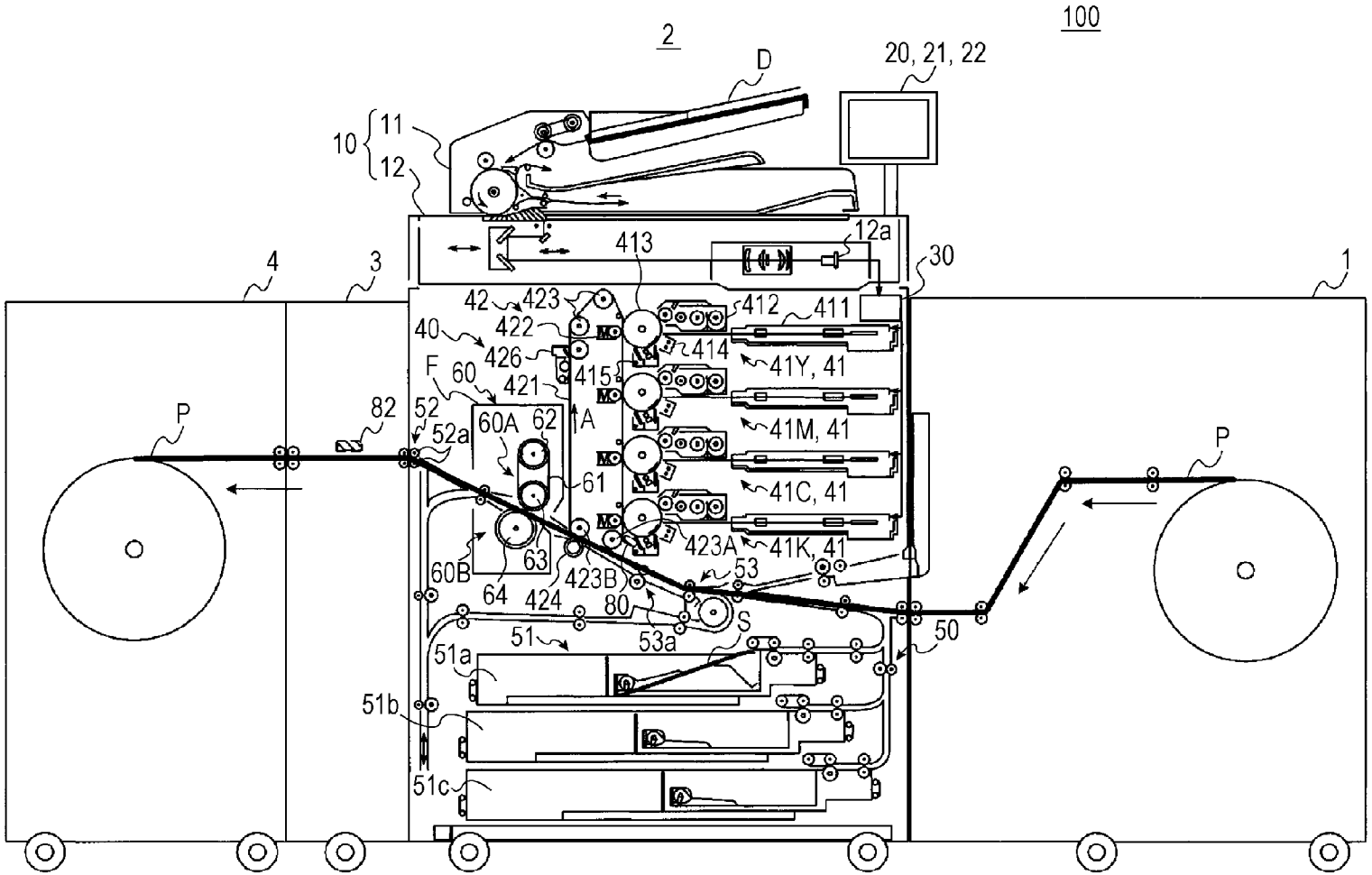
FIG. 1 is a schematic diagram of a whole structure of an image forming system according to an embodiment.
Figure 2:
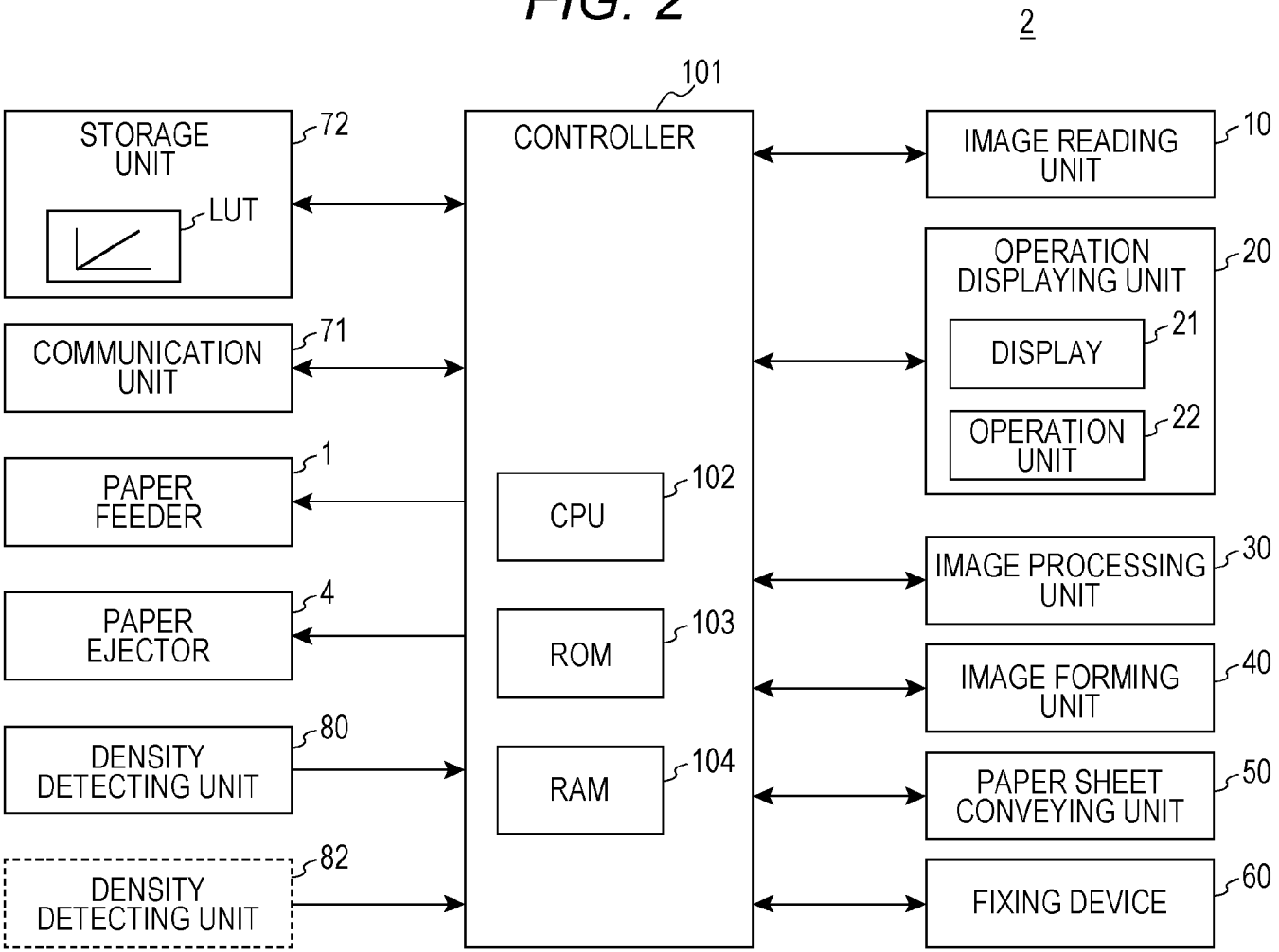
FIG. 2 is a diagram of a main part of a control system of an image forming apparatus according to the embodiment.

Hereinafter, an embodiment of the present invention will be described in detail with reference to the drawings. However, the scope of the invention is not limited to the illustrated examples. FIG. 1 is a schematic diagram of a whole structure of an image forming system 100 according to the present embodiment. FIG. 2 is a diagram of a main part of a control system of an image forming apparatus 2 included in the image forming system 100 according to the present embodiment. The image forming system 100 uses a long paper sheet P indicated by a heavy line in FIG. 1 or a paper sheet (also, referred to as "cut sheet") S which is cut into a predetermined paper size as recording media and forms an image on the long paper sheet P or the paper sheet S. Here, the long paper sheet P has, for example, a length longer than the body width of the image forming apparatus 2 in its conveying direction. In the present embodiment, a rolled label roll in which label paper sheets are temporarily bonded on a long-sized mount at regular intervals in a removable form is used as the long paper sheet P.

As illustrated in FIG. 1, the image forming system 100 includes a paper feeder 1, the image forming apparatus 2, a paper sheet processing device 3, and a paper ejector 4 from the upstream side along the conveying direction of the long paper sheet P (also, referred to as "paper sheet conveying direction" below). These components are connected to each other. The paper feeder 1, the paper sheet processing device 3, and the paper ejector 4 are used to form an image on the long paper sheet P.

The paper feeder 1 feeds the long paper sheet P to the image forming apparatus 2. As illustrated in FIG. 1, the roll-shaped long paper sheet P is rotatably held by being wound around a supporting shaft in a housing of the paper feeder 1. The paper feeder 1 conveys the long paper sheet P wound around the supporting shaft to the image forming apparatus 2 at a regular speed via a plurality of pairs of convey rollers (for example, delivery roller and paper feeding roller). A controller 101 included in the image forming apparatus 2 controls a feeding operation of the paper feeder 1.

It is not necessary for the long paper sheet P to be held in a roll shape in the paper feeder 1. A plurality of long paper sheets P having a predetermined size (for example, 210 mm×1200 mm) may be held.

The image forming apparatus 2 is a color image forming apparatus of an intermediate transfer system using an electrophotographic processing technology. That is, the image forming apparatus 2 primarily transfers all color toner images of yellow (Y), magenta (M), cyan (C), and black (K) formed on photoreceptor drums 413 to an intermediate transfer belt 421, and the four-color toner images are superimposed on the intermediate transfer belt 421. After that, the image forming apparatus 2 forms the image by secondarily transferring them on the long paper sheet P fed from the paper feeder 1 or the paper sheets S respectively sent from paper feeding tray units 51*a* to 51*c*.

Further, the image forming apparatus 2 employs a tandem system in which the photoreceptor drums 413 corresponding to the four colors of YMCK are arranged in series in the traveling direction of the intermediate transfer belt 421 and toner images of the respective colors are sequentially transferred by using a single procedure to the intermediate transfer belt 421.

As illustrated in FIG. 2, the image forming apparatus 2 includes an image reading unit 10, an operation displaying unit 20, an image processing unit 30, an image forming unit 40, a paper sheet conveying unit 50, a fixing device 60, and the controller 101.

The controller 101 includes a central processing unit (CPU) 102, a read only memory (ROM) 103, a random access memory (RAM) 104, and the like. The CPU 102 reads a program according to processing contents from the ROM 103 and develops the read program to the RAM 104. Then, the CPU 102 centrally controls an operation of each block of the image forming apparatus 2 in cooperation with the developed program. At this time, various data stored in a storage unit 72 is referred. The storage unit 72 includes, for example, a non-volatile semiconductor memory (so-called flash memory) and a hard disk drive.

The controller 101 transmits/receives various data to/from an external device (for example, personal computer) connected to a communication network such as local area network (LAN) and wide area network (WAN) via a communication unit 71. For example, the controller 101 receives image data transmitted from the external device and forms an image on the long paper sheet P or the paper sheet S based on the image data (input image data). The communication unit 71 is configured of a communication control card such as a LAN card.

The image reading unit 10 includes an automatic document paper feeder 11 called as an auto document feeder (ADF), a document image scanner 12 (scanner), and the like.

The automatic document paper feeder 11 conveys a document D placed on a document tray by a conveying mechanism and sends it to the document image scanner 12. The automatic document paper feeder 11 can continuously read images of a plurality of documents D placed on the document tray (including both sides) at once.

The document image scanner 12 optically scans the document conveyed on contact glass from the automatic document paper feeder 11 or the document placed on the contact glass and forms an image by using reflected light from the document on a light receiving surface of a charge coupled device (CCD) sensor 12*a*. Then, the document image scanner 12 reads a document image. The image reading unit 10 generates the input image data based on the reading result by the document image scanner 12. Predetermined image processing is performed to the input image data in the image processing unit 30.

The operation displaying unit 20 includes, for example, a liquid crystal display (LCD) with a touch panel and functions as a display 21 and an operation unit 22. The display 21 displays various operation screens, status of the image, and an operation state of each function according to a display control signal input from the controller 101. The operation unit 22 includes various operation keys such as a numeric keypad and a start key. The operation unit 22 receives various input operations by a user and outputs an operation signal to the controller 101.

The image processing unit 30 includes a circuit and the like which performs digital image processing according to an initial setting or a user setting relative to the input image data. For example, the image processing unit 30 performs gradation correction based on gradation correction data (gradation correction table) under the control of the controller 101. Further, the image processing unit 30 performs various correction processing such as color correction and shading correction and compression processing, in addition to the gradation correction, relative to the input image data. The image forming unit 40 is controlled based on the image data to which the above processing has been performed.

The image forming unit 40 includes image forming units 41Y, 41M, 41C, and 41K to form an image by using colored toners of a Y component, an M component, a C component, and a K component based on the input image data and an intermediate transfer unit 42.

The image forming units 41Y, 41M, 41C, and 41K for the Y component, the M component, the C component, and the K component have similar structures to each other. For convenience of explanation and illustration, common components are indicated by the same symbol, and the symbols are indicated with alphabets such as Y, M, C, and K when each components is distinguished. In FIG. 1, the component of the image forming unit 41Y for the Y component is denoted with the symbol, and the symbols of the other components of the image forming units 41M, 41C, and 41K are omitted.

The image forming unit 41 includes an exposing device 411, a developing device 412, the photoreceptor drums 413, a charging device 414, a drum cleaning device 415, and the like.

The photoreceptor drum 413 is, for example, a negative charge type organic photo-conductor (OPC) in which an under coat layer (UCL), a charge generation layer (CGL), and a charge transport layer (CTL) are sequentially laminated on a peripheral surface of a conductive cylinder (aluminum tube stock) made of aluminum having a drum diameter of 80 mm. The charge generation layer is configured of an organic semiconductor in which a charge generation material (for example, phthalocyanine pigment) is dispersed in a resin binder (for example, polycarbonate), and the charge generation layer generates a pair of a positive and negative charges by the exposure by the exposing device 411. The charge transport layer is configured by dispersing a hole transporting material (electron-donating nitrogen-containing compound) in a resin binder (for example, polycarbonate resin) and transports the positive charge generated in the charge generation layer to a surface of the charge transport layer.

The controller 101 rotates the photoreceptor drums 413 at a regular peripheral speed by controlling a drive current supplied to a drive motor (not shown) which rotates the photoreceptor drums 413.

The charging device 414 uniformly charges the surface of the photoreceptor drum 413 having photoconductivity to the negative polarity. The exposing device 411 is configured of, for example, a semiconductor laser and irradiates the photoreceptor drum 413 with a laser beam corresponding to the image of each color component. The positive charge is generated in the charge generation layer of the photoreceptor drum 413 and is transported to the surface of the charge transport layer. Accordingly, a surface charge (negative charge) of the photoreceptor drum 413 is neutralized. An electrostatic latent image of each color component is formed on the surface of the photoreceptor drum 413 by a potential difference with the surroundings.

The developing device 412 is a developing device of two component developing system. The developing device 412 visualizes the electrostatic latent image by attaching the toner of each color component to the surface of the photoreceptor drum 413 and forms the toner image.

The drum cleaning device 415 includes a drum cleaning blade for sliding on the surfaces of the photoreceptor drums 413 and removes a transfer residual toner remaining on the surfaces of the photoreceptor drums 413 after the primary transfer.

The intermediate transfer unit 42 includes the intermediate transfer belt 421, primary transfer rollers 422, a plurality of support rollers 423, a secondary transfer roller 424, a belt cleaning device 426, and the like.

The intermediate transfer belt 421 is configured of an endless belt and is stretched by the plurality of support rollers 423 in a loop shape. At least one of the plurality of support rollers 423 is configured of a driving roller, and other support rollers are configured of driven rollers. For example, it is preferable that a roller 423A, which is arranged on the downstream side in the belt traveling direction of the primary transfer roller 422 for the K component, be the driving roller. According to this, it is easy to maintain a traveling speed of the belt in a primary transfer unit to be constant. The intermediate transfer belt 421 travels in a direction of an arrow A at a regular speed by rotating the driving roller 423A.

The intermediate transfer belt 421 is a belt having conductivity and elasticity and has a high-resistance layer on its surface. The volume resistivity of the high-resistance layer is 8 to 11 log Ω·cm. The intermediate transfer belt 421 is rotated and driven by a control signal from the controller 101. A material, thickness, and hardness of the intermediate transfer belt 421 are not limited when the intermediate transfer belt 421 has conductivity and elasticity.

The primary transfer roller 422 is arranged on an inner surface side of the intermediate transfer belt 421 and arranged opposed to the photoreceptor drum 413 of each color component. A primary transfer nip to transfer the toner image from the photoreceptor drum 413 to the intermediate transfer belt 421 is formed by pressing the primary transfer roller 422 against the photoreceptor drum 413 as sandwiching the intermediate transfer belt 421.

The secondary transfer roller 424 is arranged on an outer peripheral surface side of the intermediate transfer belt 421 and arranged opposed to a backup roller 423B arranged on the downstream side in the belt traveling direction of the driving roller 423A. A secondary transfer nip to transfer the toner image from the intermediate transfer belt 421 on the long paper sheet P or the paper sheet S by pressing the secondary transfer roller 424 against the backup roller 423B as sandwiching the intermediate transfer belt 421.

When the intermediate transfer belt 421 passes through the primary transfer nip, the toner images on the photoreceptor drums 413 are sequentially overlapped with each other and primarily transferred on the intermediate transfer belt 421. Specifically, a primary transfer bias is applied to the primary transfer roller 422, and a charge of the opposite polarity to the toner is applied on a rear surface side (a side abutting to the primary transfer roller 422) of the intermediate transfer belt 421. According to this, the toner image is electrostatically transferred on the intermediate transfer belt 421.

After that, when the long paper sheet P or the paper sheet S passes through the secondary transfer nip, the toner image on the intermediate transfer belt 421 is secondarily transferred on the long paper sheet P or the paper sheet S. Specifically, a secondary transfer bias is applied to the secondary transfer roller 424, and the charge of the opposite polarity to the toner is applied on a rear surface side (a side abutting to the secondary transfer roller 424) of the long paper sheet P or the paper sheet S. According to this, the toner image is electrostatically transferred on the long paper sheet P or the paper sheet S. The long paper sheet P or the paper sheet S on which the toner image has been transferred is conveyed toward the fixing device 60.

The belt cleaning device 426 removes the transfer residual toner remaining on the surface of the intermediate transfer belt 421 after the secondary transfer. Instead of the secondary transfer roller 424, a structure in which a secondary transfer belt is stretched in a loop shape (so-called belt-type secondary transfer unit) by the plurality of support rollers including the secondary transfer roller may be employed.

A concentration detecting unit 80 is arranged on the downstream side of the image forming unit 41K and the upstream side of the secondary transfer nip in the belt traveling direction of the intermediate transfer belt 421. The concentration detecting unit 80 detects an amount of attached toner (concentration) of the toner image (patch image) to detect the concentration unevenness formed on the intermediate transfer belt 421 and outputs the detection result to the controller 101. A reflection type optical sensor including a light emitting element such as a light emitting diode (LED) and a light receiving element such as a photodiode (PD) can be applied as the concentration detecting unit 80. The concentration of the patch image is expressed as $-\log(I/I_0)$ when it is assumed that the amount of incident light to the patch image be $I_0$ and the amount of the reflected light from the patch image be I. As it is obvious from this formula, when the concentration of the patch image formed on the intermediate transfer belt 421 gets higher, the receiving light amount of the light receiving element is reduced so that the amount of the reflected light I is reduced. Further, a sensor output value output from the concentration detecting unit 80 gets smaller. Conversely, when the concentration of the patch image formed on the intermediate transfer belt 421 gets smaller, the receiving light amount of the light receiving element increases so that the amount of the reflected light I increases. Further, the sensor output value output from the concentration detecting unit 80 gets larger.

The concentration detecting unit 80 is used when image stabilization control to faithfully reproduce the concentration of the input image in the output image is performed. The image stabilization control is performed, for example, when a power switch is turned on, every time when a predetermined number of paper sheets are printed, when a variation amount of ambient environment of the device (such as temperature and humidity) exceeds a predetermined range, and at the time of recovery from a trouble such as a failure.

The fixing device 60 includes a upper-side fixing device 60A having a fixing-surface-side member arranged on a side of a fixing surface (surface on which the toner image has been formed) of the long paper sheet P or the paper sheet S and a lower-side fixing device 60B having a rear-surface-side support member arranged on a side of a rear surface (surface opposite to the fixing surface) of the long paper sheet P or the paper sheet S. A fixing nip which sandwiches and conveys the long paper sheet P or the paper sheet S is formed by pressing the rear-surface-side support member against the fixing-surface-side member.

The fixing device 60 fixes the toner image on the long paper sheet P or the paper sheet S by heating and pressurizing the conveyed long paper sheet P or the paper sheet S, on which the toner image has been secondarily transferred, by the fixing nip. The fixing device 60 is arranged in a fixing unit F as a unit. Further, an air separation unit may be arranged in the fixing unit F. The air separation unit separates the long paper sheet P or the paper sheet S from the fixing-surface-side member or the rear-surface-side support member by blowing air.

The upper-side fixing device 60A includes an endless fixing belt 61 which is the fixing-surface-side member, a heating roller 62, and a fixing roller 63 (belt heating system). The fixing belt 61 is stretched by the heating roller 62 and the fixing roller 63 with a predetermined belt tension (for example, 40 N).

The fixing belt 61 uses, for example, PI (polyimide) having the thickness of 80 μm as a substrate and covers the outer peripheral surface of the substrate with heat-resistant silicone rubber (hardness, JIS-A30°) having the thickness of 250 μm as the elastic layer. In addition, a surface layer (release layer) is coated with PFA (perfluoroalkoxy) which is heat-resistant resin having the thickness of 70 μm. An outer diameter of the fixing belt 61 is, for example, 100 mm. The fixing belt 61 has contact with the long paper sheet P or the paper sheet S on which the toner image has been formed and heats and fixes the toner image on the long paper sheet P or the paper sheet S at a fixing temperature (for example, 160 to 200° C.). Here, the fixing temperature is a temperature at which heat quantity necessary for melting the toner on the long paper sheet P or the paper sheet S can be supplied. The fixing temperature is different according to the paper type of the long paper sheet P or the paper sheet S to which the image is formed.

The heating roller 62 has a heating source (halogen heater) therein and heats the fixing belt 61. The heating source heats the heating roller 62, and as a result, the fixing belt 61 is heated. The temperature of the heating source is controlled by the controller 101 so that the temperature of the fixing belt 61 is 180° C. which is the setting temperature. An outer diameter of the heating roller 62 is, for example, 50 mm.

The fixing roller 63 has a structure in which an elastic layer formed of silicone rubber and the like (for example, thickness is 10 mm) and a surface layer formed of a fluororesin such as PTFE (for example, thickness is 70 μm) are laminated and formed in this order on the outer peripheral surface of a cylindrical metal core formed of aluminum and the like. An outer diameter of the fixing roller 63 is, for example, 40 mm. The controller 101 drives and controls the fixing roller 63 (for example, on/off of the rotation and the peripheral speed). The controller 101 rotates the fixing roller 63 in the clockwise direction. The fixing belt 61 and the heating roller 62 are driven to rotate in the clockwise direction by rotating the fixing roller 63.

The lower-side fixing device 60B includes a pressure roller 64 which is the rear-surface-side support member (roller pressurization system). The pressure roller 64 has a structure in which an elastic layer formed of silicone rubber and the like and a surface layer formed of a PFA tube are laminated and formed in this order on the outer peripheral surface of the cylindrical metal core formed of iron and the like. An outer diameter of the pressure roller 64 is, for example, 40 mm. The pressure roller 64 is pressed by a pressure separation unit (not shown) against the fixing roller 63 via the fixing belt 61 at a predetermined fixing load (for example, 1000 N). The pressure separation unit has a known structure and presses/separates the fixing belt 61 against/from the pressure roller 64. In this way, the fixing nip for sandwiching and conveying the long paper sheet P or the paper sheet S is formed between the fixing belt 61 and the pressure roller 64. The controller 101 drives and controls the pressure roller 64 (for example, on/off of the rotation and the peripheral speed) and the pressure separation unit. The controller 101 rotates the pressure roller 64 in the counter-clockwise direction.

The paper sheet conveying unit 50 includes a paper feeding unit 51, a paper ejecting unit 52, a convey passage 53, and the like. Each of three paper feeding tray units 51*a* to 51*c* included in the paper feeding unit 51 stores the paper sheet S (standard paper sheet and special paper sheet) identified based on basis weight and size by each kind which has been previously set. The convey passage 53 has a plurality of pairs of convey rollers including a pair of resist rollers 53*a*. The resist roller unit in which the pair of resist rollers 53*a* has been arranged corrects inclination and deflection of the paper sheet S or the long paper sheet P.

The paper sheets S stored in the paper feeding tray units 51*a* to 51*c* are sent one by one from the top and conveyed to the image forming unit 40 by the convey passage 53. In the image forming unit 40, the toner image of the intermediate transfer belt 421 is secondarily transferred on the other surface of the paper sheet S in a collective manner, and the fixing device 60 performs a fixing process. Further, the long paper sheet P fed from the paper feeder 1 to the image forming apparatus 2 is conveyed to the image forming unit 40 by the convey passage 53. In the image forming unit 40, the toner image on the intermediate transfer belt 421 is secondarily transferred on the other surface of the long paper sheet P in a collective manner, and the fixing device 60 performs the fixing process. The long paper sheet P or the paper sheet S to which the image has been formed is conveyed to the paper sheet processing device 3 by the paper ejecting unit 52 including the pair of convey rollers (a pair of paper ejecting rollers) 52*a*.

The paper sheet processing device 3 is provided on the downstream side of the image forming apparatus 2 in the paper sheet conveying direction and on the upstream side if the paper ejector 4. The paper sheet processing device 3 functions as a relay device (intermediate device) and conveys the long paper sheet P ejected from the image forming apparatus 2 to the paper ejector 4.

The paper ejector 4 winds and stores the long paper sheet P conveyed from the paper sheet processing device 3. For example, as illustrated in FIG. 1, the long paper sheet P is wound around the supporting shaft and held in a rolled shape in the housing of the paper ejector 4. Therefore, the paper ejector 4 winds the long paper sheet P conveyed from the paper sheet processing device 3 around the supporting shaft at a regular speed via the plurality of pairs of convey rollers (such as delivery roller paper and ejecting roller). The controller 101 included in the image forming apparatus 2 controls the winding operation of the paper ejector 4.

There is a problem in that, in the image forming apparatus 2, the image quality of the output image (image formed on the paper sheet S or the long paper sheet P) is deteriorated by deterioration of the photoreceptor drum 413, developer, and the like with time, the ambient environment of the device (change of temperature and humidity), and the like. Specifically, a phenomenon occurs in which colors of the input image are not faithfully reproduced in the output image and a color tone of the image is different from that of the other image. The image forming apparatus 2 performs the image stabilization control so as to secure color reproducibility and color stability.

In the image stabilization control, the concentration detecting unit 80 detects the concentration of the patch image (toner pattern) formed on the intermediate transfer belt 421, and the feedback of the detection result is reflected to an image forming condition such as a charged potential, a developing potential, and an exposure amount. Accordingly, the concentration of the image is corrected.

Further, in the image forming apparatus 2, there is a case where the concentration unevenness in the circumferential direction (vertical scanning direction) is generated in the toner image formed on the photoreceptor drum 413. The concentration unevenness is caused by change of the distance between the photoreceptor drum 413 and the developing roller due to rotational deflection of the developing roller (not shown) included in the developing device 412 and humidity unevenness in the rotary axis direction of the photoreceptor drum 413. In this case, the concentration unevenness is generated in the image formed on the intermediate transfer belt 421 and the paper sheet S or the long paper sheet P by synchronizing with rotation cycles of the developing roller and the photoreceptor drum 413.

Regarding the concentration unevenness, the controller 101 reduces the concentration unevenness by performing gradation correction processing relative to the image data based on the detection result by the concentration detecting unit 80 in the patch image formed on the intermediate transfer belt 421. For example, the controller 101 adjusts the concentration of a part where the concentration is lower than the other to be high. Further, the controller 101 adjusts the concentration of a part where the concentration is higher than the other to be low. The concentration is adjusted by changing setting values of a developing bias and a toner concentration as the image forming condition.

Figure 3:
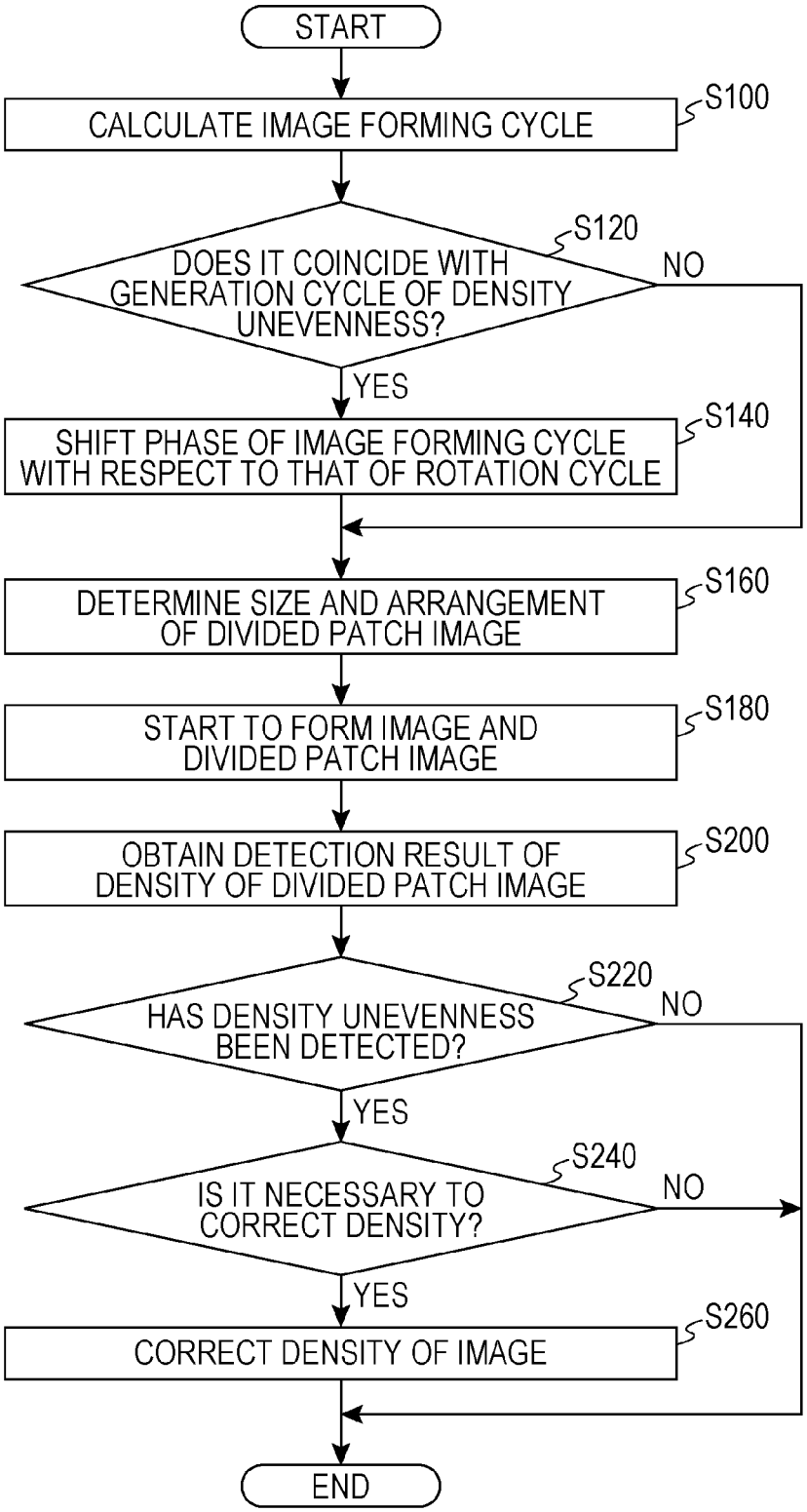
FIG. 3 is a flowchart of a control operation of the image forming system according to the embodiment.

More specifically, image concentration correction processing is performed according to a flowchart illustrated in FIG. 3. The image concentration correction processing illustrated in FIG. 3 is realized by executing a predetermined program stored in the ROM 103 by the CPU 102, for example, in accordance with the power supply to the image forming system 100. Here, the image concentration correction processing will be described which is performed when the concentration unevenness in the vertical scanning direction is caused by the humidity unevenness in the axis direction of the photoreceptor drum 413 in a case where the image is formed on the paper sheet S.

Figure 4A:
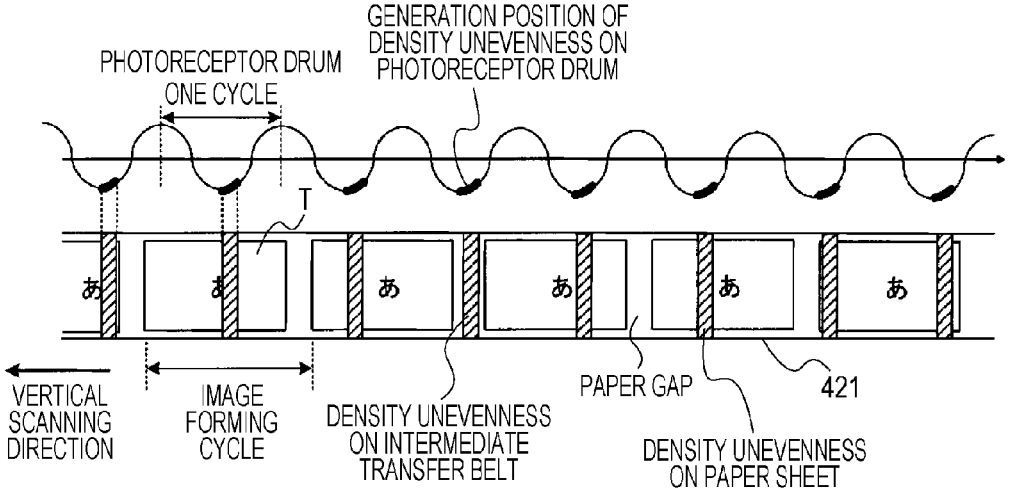
FIGS. 4A and 4B are diagrams of generation positions of concentration unevenness and a forming positions of divided patch images in the vertical scanning direction.

FIG. 4A is a diagram of a state where the concentration unevenness (refer to the heavy line part in FIG. 4A) in the circumferential direction (vertical scanning direction) is generated in the image formed on the photoreceptor drum 413 due to the humidity unevenness in the rotary axis direction of the photoreceptor drum 413. Further, in an image forming region T (region where the image to be transferred on a single paper sheet S is formed) on the intermediate transfer belt 421, the concentration unevenness (refer to an oblique line part in FIG. 4A) is generated by synchronizing with the rotation cycle of the photoreceptor drum 413. The concentration unevenness is also generated in a non-image forming region of the intermediate transfer belt 421. The non-image forming region is a region between the image forming regions T and is generally called as a "paper gap".

The controller 101 calculates an image forming cycle in which the image is formed on the intermediate transfer belt 421 (step S100). The image forming cycle is time from the start to form the image to be transferred on one paper sheet S to the start to form the image to be transferred on the following paper sheet S.

Next, the controller 101 determines whether phases of the rotation cycle of the photoreceptor drum 413, that is, a generation cycle of the concentration unevenness on the intermediate transfer belt 421 and the image forming cycle calculated in step S100 coincide with each other (step S120). As a result of this determination, when the phase of the generation cycle of the concentration unevenness does not coincide with that of the image forming cycle (step S120, NO), the procedure proceeds to step S160. On the other hand, when the phase of the generation cycle of the concentration unevenness coincides with that of the image forming cycle (step S120, YES), the controller 101 controls the image forming unit 40 so as to shift the phase of the generation cycle of the concentration unevenness with respect to that of the image forming cycle (step S140). Specifically, the controller 101 shifts the phase of the generation cycle of the concentration unevenness with respect to that of the image forming cycle by changing the generation cycle of the concentration unevenness by changing the development θ (peripheral speed ratio of the developing roller of the developing device 412 and the photoreceptor drum 413) or by changing the image forming cycle. After that, the procedure proceeds to step S160.

Next, the controller 101 determines the size and the arrangement of the patch image for image concentration detection to be formed on the intermediate transfer belt 421 according to the size and the arrangement of the image forming region T on the intermediate transfer belt 421 (step S160). In the present embodiment, the controller 101 forms a plurality of divided patch images on the intermediate transfer belt 421 at regular intervals. The plurality of divided patch images is obtained by dividing the patch image in the rotation direction (vertical scanning direction) of the intermediate transfer belt 421.

Figure 4B:
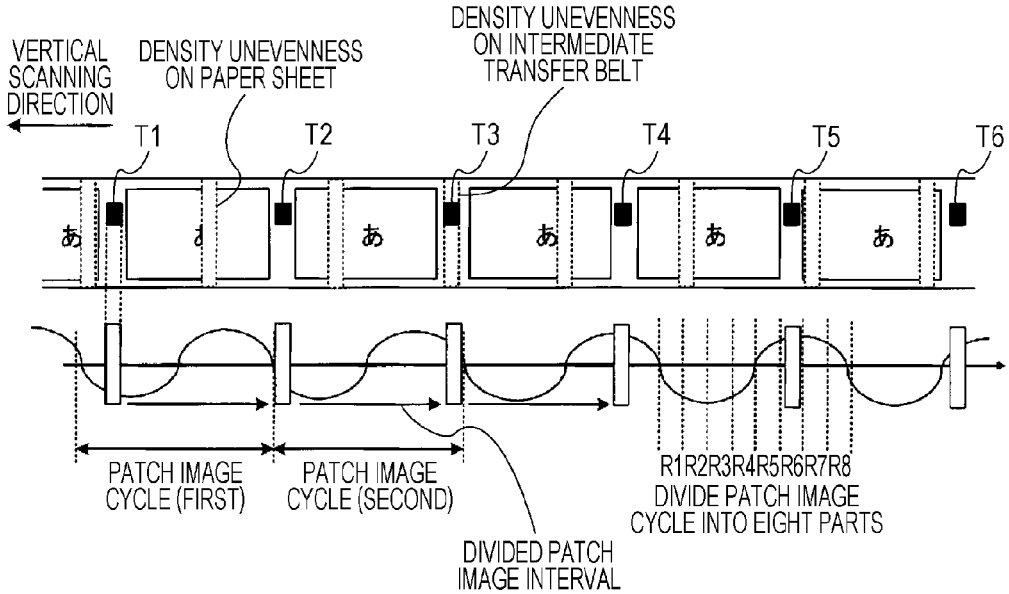

FIG. 4B is a diagram of divided patch images T1 to T6 formed on the intermediate transfer belt 421. As illustrated in FIG. 4B, the divided patch images T1 to T6 are formed in the paper gaps on the intermediate transfer belt 421, that is, at regular intervals. In FIG. 4B, a patch image cycle is a time from the start to form the patch image to the end when the patch image is formed on the intermediate transfer belt 421. The controller 101 divides the patch image cycle into eight parts. In a period that coincides with the paper gap in the eight divided periods R1 to R8, the divided patch images are formed.

The divided patch image T1 is formed in the period R2 in the first patch image cycle. A forming position of the divided patch image T1 does not coincide with a generation position of the concentration unevenness generated on the intermediate transfer belt 421. Further, the divided patch image T2 is formed in the period R1 in the second patch image cycle. A forming position of the divided patch image T2 does not coincide with the generation position of the concentration unevenness generated on the intermediate transfer belt 421. Further, the divided patch image T3 is formed in the period R8 in the second patch image cycle. A forming position of the divided patch image T3 coincides with the generation position of the concentration unevenness generated on the intermediate transfer belt 421. As described above, time interval of the forming position of the divided patch images T1 to T3, that is, time interval of the paper gaps is a time corresponding to seven periods of the period which is obtained by dividing the patch image cycle into eight parts. Similarly, the divided patch image T4 to T6 are formed on the intermediate transfer belt 421 at each time interval corresponding to the seven periods of the period which is obtained by dividing the patch image cycle into eight parts.

Next, the controller 101 controls the image forming unit 40 to start the formation of the image to be transferred on the paper sheet S and the plurality of divided patch images (step S180). The concentration detecting unit 80 detects the concentration of the divided patch image formed on the intermediate transfer belt 421 and outputs the detection result to the controller 101. The controller 101 obtains the detection result regarding the concentration of the divided patch image output from the concentration detecting unit 80 (step S200).

Next, the controller 101 detects the concentration unevenness of the image in the vertical scanning direction based on the obtained detection result. The vertical scanning direction is the paper sheet conveying direction of the paper sheet S. Here, an example of the detection of the concentration unevenness will be described with reference to FIG. 5.

FIG. 5 is a table of a relation between the generation positions of the concentration unevenness and patch image forming positions. Here, it is assumed that the concentration unevenness is generated at the circumferential direction position A of the circumferential direction positions A to E of the toner images formed on the photoreceptor drum 413. As described with reference to FIG. 4B, the divided patch images are formed on the intermediate transfer belt 421 at the time interval corresponding to the seven periods of the period which is obtained by dividing the patch image cycle into eight parts. For example, the patch images are formed in the period R2 in the first patch image cycle, in the periods R1 and R8 in the second cycle, in the period R7 in the third cycle, in the period R6 in the fourth cycle, and in the period R5 in the fifth cycle.

A position (paper gap position) on the intermediate transfer belt 421 corresponding to the period R2 in the first patch image cycle corresponds to the circumferential direction position B of the toner image formed on the photoreceptor drum 413. That is, the paper gap position does not correspond to the generation position of the concentration unevenness. Further, a position (paper gap position) on the intermediate transfer belt 421 corresponding to the period R1 in the second patch image cycle corresponds to the circumferential direction position D of the toner image formed on the photoreceptor drum 413. That is, the paper gap position does not correspond to the generation position of the concentration unevenness. Further, a position (paper gap position) on the intermediate transfer belt 421 corresponding to the period R8 in the second patch image cycle corresponds to the circumferential direction position A of the toner image formed on the photoreceptor drum 413. That is, the paper gap position corresponds to the generation position of the concentration unevenness. Further, a position (paper gap position) on the intermediate transfer belt 421 corresponding to the period R7 in the third patch image cycle corresponds to the circumferential direction position C of the toner image formed on the photoreceptor drum 413. That is, the paper gap position does not correspond to the generation position of the concentration unevenness. Further, a position (paper gap position) on the intermediate transfer belt 421 corresponding to the period R6 in the fourth patch image cycle corresponds to the circumferential direction position E of the toner image formed on the photoreceptor drum 413. That is, the paper gap position does not correspond to the generation position of the concentration unevenness. Further, a position (paper gap position) on the intermediate transfer belt 421 corresponding to the period R5 in the fifth patch image cycle corresponds to the circumferential direction position B of the toner image formed on the photoreceptor drum 413. That is, the paper gap position does not correspond to the generation position of the concentration unevenness.

The controller 101 can detect the generation of the concentration unevenness at the circumferential direction position A and the degree of the generation of the concentration unevenness (that is, concentration difference) by comparing the concentration of the divided patch image formed at the position on the intermediate transfer belt 421 corresponding to the circumferential direction position A where the concentration unevenness is generated with that of the divided patch image formed at the position on the intermediate transfer belt 421 corresponding to each circumferential direction positions B to E where the concentration unevenness is not generated.

When the controller 101 has not detected the generation of the concentration unevenness (step S220, NO), the image forming system 100 terminates the procedure in FIG. 3. On the other hand, when the controller 101 has detected the generation of the concentration unevenness (step S220, YES), the controller 101 determines whether it is necessary to correct the concentration of the image formed on the paper sheet S according to the degree of the generation of the concentration unevenness which has been detected (step S240). As a result of this determination, when it is not necessary to correct the concentration of the image (step S240, NO), the image forming system 100 terminates the procedure in FIG. 3. On the other hand, when it is necessary to correct the concentration of the image, that is, when the concentration unevenness is large (step S240, YES), the controller 101 determines a concentration correction value of the image according to the degree of the generation of the concentration unevenness which has been detected and performs concentration correction processing to the image (step S260).

When the image is formed on the long paper sheet P, image concentration correction processing can be realized by using the procedure similar to the image concentration correction processing described above. The image concentration correction processing is performed when the concentration unevenness in the vertical scanning direction is caused by the change of the distance between the photoreceptor drum 413 and the developing roller due to the rotational deflection of the developing roller.

Figure 6A:
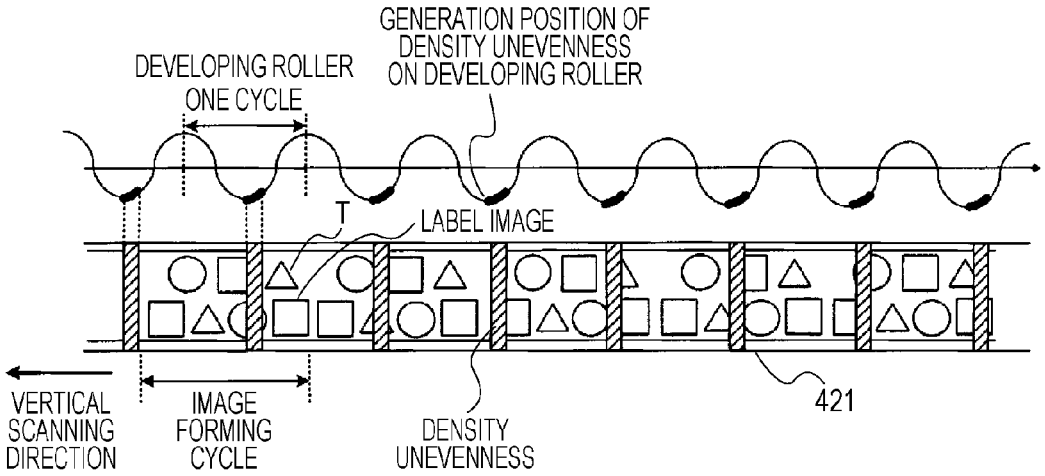
FIGS. 6A and 6B are diagrams of the generation positions of concentration unevenness and the forming positions of the divided patch images in the vertical scanning direction.

FIG. 6A is a diagram of a state where the concentration unevenness (refer to the heavy line part in FIG. 6A) in the circumferential direction (vertical scanning direction) is generated in the image formed on the photoreceptor drum 413 due to the rotational deflection of the developing roller. Further, in the image forming region T (region where a label image to be transferred to the long paper sheet P is formed) on the intermediate transfer belt 421, the concentration unevenness (refer to the oblique line part in FIG. 6A) is generated by synchronizing with the rotation cycle of the developing roller. According to the flowchart in FIG. 3, the image concentration correction processing will be described below which is performed when the concentration unevenness in the vertical scanning direction is generated due to the rotational deflection of the developing roller.

First, the controller 101 calculates the image forming cycle in which a label image (in the example in FIG. 6A, a plurality of label images) is formed on the intermediate transfer belt 421 (step S100). Next, the controller 101 determines whether phases of the rotation cycle of the developing roller, that is, the generation cycle of the concentration unevenness on the intermediate transfer belt 421 and the image forming cycle calculated in step S100 coincide with each other (step S120). As a result of this determination, when the phase of the generation cycle of the concentration unevenness does not coincide with that of the image forming cycle (step S120, NO), the procedure proceeds to step S160. On the other hand, when the phase of the generation cycle of the concentration unevenness coincides with that of the image forming cycle (step S120, YES), the controller 101 controls the image forming unit 40 so as to shift the phase of the generation cycle of the concentration unevenness with respect to that of the image forming cycle (step S140). After that, the procedure proceeds to step S160.

Next, the controller 101 determines the size and the arrangement of the patch image for image concentration detection to be formed on the intermediate transfer belt 421 according to the size and the arrangement of the image forming region T on the intermediate transfer belt 421 (step S160). Specifically, the controller 101 forms a plurality of divided patch images on the intermediate transfer belt 421 at regular intervals. The plurality of divided patch images is obtained by dividing the patch image in the rotation direction (vertical scanning direction) of the intermediate transfer belt 421.

Figure 6B:
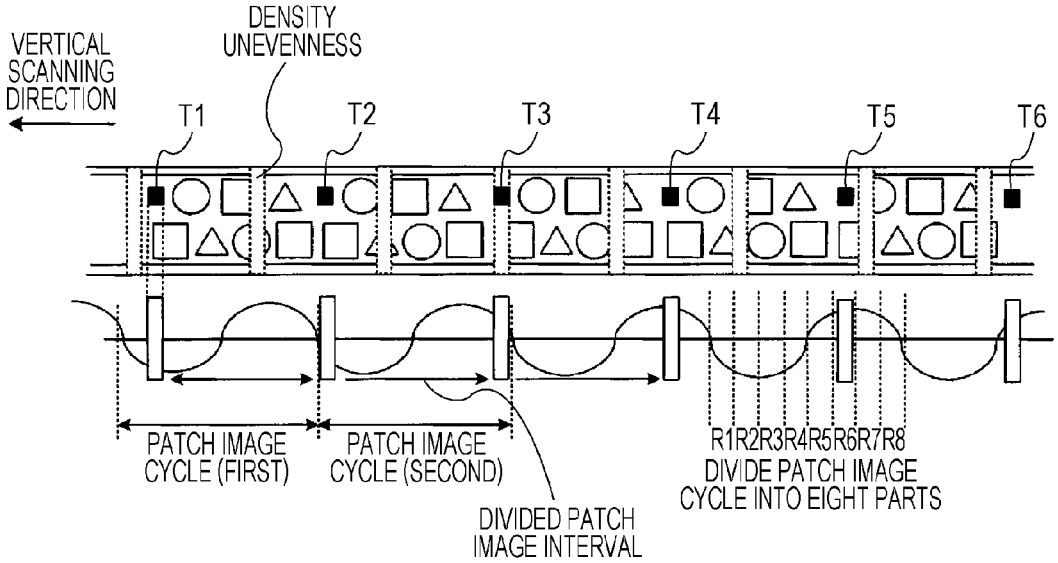

FIG. 6B is a diagram of the divided patch images T1 to T6 formed on the intermediate transfer belt 421. As illustrated in FIG. 6B, the divided patch images T1 to T6 are formed in a second region (margin) other than a first region, where the label image is formed, in the image forming region T on the intermediate transfer belt 421 at regular intervals. In FIG. 6B, the patch image cycle is a time from the start to form the patch image to the end when the patch image is formed on the intermediate transfer belt 421. The controller 101 divides the patch image cycle into eight parts. In a period that coincides with the paper gap of the eight divided periods R1 to R8, the divided patch images are formed.

The divided patch image T1 is formed in the period R2 in the first patch image cycle. A forming position of the divided patch image T1 does not coincide with a generation position of the concentration unevenness generated on the intermediate transfer belt 421. Further, the divided patch image T2 is formed in the period R1 in the second patch image cycle. A forming position of the divided patch image T2 does not coincide with the generation position of the concentration unevenness generated on the intermediate transfer belt 421. Further, the divided patch image T3 is formed in the period R8 in the second patch image cycle. A forming position of the divided patch image T3 coincides with the generation position of the concentration unevenness generated on the intermediate transfer belt 421. As described above, time interval of the forming positions of the divided patch images T1 to T3, that is, time interval of the margins is a time corresponding to seven periods of the period which is obtained by dividing the patch image cycle into eight parts. Similarly, the divided patch image T4 to T6 are formed on the intermediate transfer belt 421 at each time interval corresponding to the seven periods of the period which is obtained by dividing the patch image cycle into eight parts.

Next, the controller 101 controls the image forming unit 40 to start the formation of the label image to be transferred on the long paper sheet P and the plurality of divided patch images (step S180). The concentration detecting unit 80 detects the concentration of the divided patch image formed on the intermediate transfer belt 421 and outputs the detection result to the controller 101. The controller 101 obtains the detection result regarding the concentration of the divided patch image output from the concentration detecting unit 80 (step S200).

Next, the controller 101 detects the concentration unevenness of the image in the vertical scanning direction based on the obtained detection result. The vertical scanning direction is the paper sheet conveying direction of the paper sheet S. In the example in FIG. 5, the controller 101 can detect the generation of the concentration unevenness at the circumferential direction position A and the degree of the generation of the concentration unevenness (that is, concentration difference) by comparing the concentration of the divided patch image formed at the position on the intermediate transfer belt 421 corresponding to the circumferential direction position A of the developing roller where the concentration unevenness is generated with that of the divided patch image formed at the position on the intermediate transfer belt 421 corresponding to each circumferential direction positions B to E of the developing roller where the concentration unevenness is not generated.

When the controller 101 has not detected the generation of the concentration unevenness (step S220, NO), the image forming system 100 terminates the procedure in FIG. 3. On the other hand, when the controller 101 has detected the generation of the concentration unevenness (step S220, YES), the controller 101 determines whether it is necessary to correct the concentration of the image formed on the paper sheet S according to the degree of the generation of the concentration unevenness which has been detected (step S240). As a result of this determination, when it is not necessary to correct the concentration of the image (step S240, NO), the image forming system 100 terminates the procedure in FIG. 3. On the other hand, when it is necessary to correct the concentration of the image, that is, when the concentration unevenness is large (step S240, YES), the controller 101 determines a concentration correction value of the image according to the degree of the generation of the concentration unevenness which has been detected and performs concentration correction processing to the image (step S260).

As described above in detail, in the present embodiment, the image forming apparatus 2 includes the rotatable intermediate transfer belt 421, the image forming unit 40, the concentration detecting unit 80 which detects the concentration of the plurality of divided patch images formed by the image forming unit 40, and the controller 101 which detects the concentration unevenness of the image in the vertical scanning direction that is the paper sheet conveying direction based on the detection result of the concentration detecting unit 80. The image forming unit 40 forms the plurality of divided patch images, which is obtained by dividing the patch image for detecting the image concentration in the rotation direction of the intermediate transfer belt 421, on the intermediate transfer belt 421 at regular intervals and forms the image (label image) to be formed on the paper sheet (the paper sheet S or the long paper sheet P) on the intermediate transfer belt 421.

According to the present embodiment configured in this way, even when the images are printed all the time and the generation positions of the concentration unevenness change with time, the concentration of the image can be corrected by forming the divided patch image on the intermediate transfer belt 421 and detecting the concentration unevenness in the vertical scanning direction without stopping performing a print job. Further, the paper gap or the margin of the normal print is large enough to form the divided patch image. Therefore, it is preferable that there be no need to widen the paper gap and the interval of the label images formed on the long paper sheet P as conventional.

Further, in the present embodiment, the controller 101 determines whether the concentration of the image is corrected or not according to the detection result of the concentration unevenness. Then, when it is necessary to correct the concentration, the controller 101 corrects the concentration of the image based on the detection result. According to this, when the degree of the generation of the concentration unevenness is not large, unnecessary processing to correct the concentration of the image can be prevented.

Further, in the present embodiment, the controller 101 determines whether the phase of the generation cycle of the concentration unevenness on the intermediate transfer belt 421 coincides with that of the image forming cycle in which the image is formed on the intermediate transfer belt 421. When determining that both phases coincide with each other, the controller 101 controls the image forming unit 40 to shift the phase of the generation cycle of the concentration unevenness with respect to the phase of the image forming cycle. Accordingly, according to the coincidence of the phases of the generation cycle of the concentration unevenness and the image forming cycle, for example, the divided patch images are formed at regular intervals as avoiding the generation position of the concentration unevenness. It can be prevented that the concentration difference of the divided patch images, that is, the concentration unevenness cannot be detected.

In the above embodiment, an example has been described in which the controller 101 corrects the concentration of the image based on the detection result of the divided patch image formed on the intermediate transfer belt 421 by the concentration detecting unit 80. However, the present invention is not limited to this. For example, the controller 101 may correct the concentration of the image based on the detection result of the divided patch image, which is formed on the intermediate transfer belt 421, and after that, transferred to the long paper sheet P, by the concentration detecting unit 82. The concentration detecting unit 80 is arranged on the convey passage of the paper sheet processing device 3. However, from a viewpoint of correcting the concentration of the image at earlier timing, it is preferable to correct the concentration of the image based on the detection result of the divided patch image formed on the intermediate transfer belt 421 by the concentration detecting unit 80.

In addition, the above embodiment has been described as a concrete example to perform the present invention. The technical range of the present invention cannot be restrictively interpreted by the embodiment. That is, the present invention can be performed in various forms without departing from the scope or the main features of the present invention.

According to an embodiment of the present invention, a concentration unevenness in the vertical scanning direction can be surely detected.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a rotatable image carrier;

an image forming unit configured to form a plurality of divided patch images, for detecting a concentration of an image in a rotation direction of the image carrier, on the image carrier at regular first intervals and form an image to be formed on a paper sheet on the image carrier;

a concentration detecting unit configured to detect the concentration of the plurality of divided patch images formed by the image forming unit; and a controller configured to combine the concentration of divided patch images detected by the concentration detecting unit in chronological order and detect concentration unevenness of the image in the vertical scanning direction which is a paper sheet conveying direction of the paper sheet, wherein the divided patch images are from a patch image cycle that is repeated at regular second intervals along the image carrier, the second intervals are different from the first intervals, the patch image cycle is divided into parts, and each one of the divided patch images belongs to a different one of the parts.

2. The image forming apparatus according to claim 1, wherein the controller determines whether to correct the concentration of the image according to the detection result of the concentration unevenness and corrects the concentration of the image based on the detection result when the concentration is corrected.

3. The image forming apparatus according to claim 1, wherein the controller determines whether a phase of a generation cycle of the concentration unevenness on the image carrier coincides with that of an image forming cycle in which the image is formed on the image carrier, and when determining that the phases coincide with each other, the controller controls the image forming unit to shift the phase of the generation cycle of the concentration unevenness with respect to the phase of the image forming cycle.

4. The image forming apparatus according to claim 1, wherein the paper sheet is a long paper sheet, and the controller controls the image forming unit to form the divided patch image in a second region other than a first region where the image is formed in an image forming region on the long paper sheet.

5. An image forming system comprising:

a paper feeder configured to feed a long paper sheet;

an image forming apparatus configured to form an image on the long paper sheet fed by the paper feeder; and a paper ejector configured to store the long paper sheet on which the image has been formed by the image forming apparatus, wherein the image forming apparatus includes a rotatable image carrier, an image forming unit which forms a plurality of divided patch images, for detecting a concentration of an image in a rotation direction of the image carrier, on the image carrier at regular first intervals and forms an image to be formed on a paper sheet on the image carrier, a concentration detecting unit which detects the concentration of the plurality of divided patch images formed by the image forming unit, and a controller which combines the concentrations of divided patch images detected by the concentration detecting unit in chronological order and detects concentration unevenness of the image in the vertical scanning direction which is a paper sheet conveying direction of the paper sheet, wherein the divided patch images are from a patch image cycle that is repeated at regular second intervals along the image carrier, the second intervals are different from the first intervals, the patch image cycle is divided into parts, and each one of the divided patch images belongs to a different one of the parts.

6. The image forming system according to claim 5, wherein the controller determines whether to correct the concentration of the image according to the detection result of the concentration unevenness and corrects the concentration of the image based on the detection result when the concentration is corrected.

7. The image forming system according to claim 5, wherein the controller determines whether a phase of a generation cycle of the concentration unevenness on the image carrier coincides with that of an image forming cycle in which the image is formed on the image carrier, and when determining that the phases coincide with each other, the controller controls the image forming unit to shift the phase of the generation cycle of the concentration unevenness with respect to the phase of the image forming cycle.

8. The image forming system according to claim 5, wherein the paper sheet is a long paper sheet, and the controller controls the image forming unit to form the divided patch image in a second region other than a first region where the image is formed in an image forming region on the long paper sheet.

9. A concentration unevenness detecting method comprising:

forming a plurality of divided patch images for detecting a concentration of an image in a rotation direction of an image carrier on the image carrier at regular first intervals and forming the image to be formed on a paper sheet on the image carrier;

detecting the concentration of the formed plurality of divided patch images; and combining the concentration of the detected divided patch images in chronological order and detecting concentration unevenness of the image in the vertical scanning direction which is a paper sheet conveying direction of the paper sheet, wherein the divided patch images are from a patch image cycle that is repeated at regular second intervals along the image carrier, the second intervals are different from the first intervals, the patch image cycle is divided into parts, and each one of the divided patch images belongs to a different one of the parts.

10. The concentration unevenness detecting method according to claim 9, wherein it is determined whether to correct the concentration of the image according to the detection result of the concentration unevenness, and the concentration of the image is corrected based on the detection result when the concentration is corrected.

11. The concentration unevenness detecting method according to claim 9, wherein it is determined whether a phase of a generation cycle of the concentration unevenness on the image carrier coincides with a phase of an image forming cycle in which the image is formed on the image carrier, and formation of the image is controlled to shift the phase of the generation cycle of the concentration unevenness with respect to the phase of the image forming cycle when it has been determined that the phases coincide with each other.

12. The concentration unevenness detecting method according to claim 9, wherein the paper sheet is a long paper sheet, and formation of the image is controlled to form the divided patch image in a second region other than a first region where the image is formed in an image forming region on the long paper sheet.

* * * * *